United States Patent [19]

Laszlo et al.

[11] 4,326,542

[45] Apr. 27, 1982

[54] FIRMNESS CONTROL IN A CIGARETTE MAKER

[75] Inventors: Tibor S. Laszlo, Arlington; John F. Nienow, Midlothian; John F. Sherwood; Christopher L. Irving, both of Richmond, all of Va.

[73] Assignee: Philip Morris Incorporated, New York, N.Y.

[21] Appl. No.: 111,607

[22] Filed: Jan. 14, 1980

[51] Int. Cl.[3] ..... A24C 5/00; A24C 5/34

[52] U.S. Cl. ..... 131/280; 131/906; 131/908

[58] Field of Search ..... 131/21 R, 21 B, 21 D, 131/21 A, 20 R, 280, 905, 906, 907, 908, 910; 328/4, 61 R; 73/32 R, 37.6, 73

[56] References Cited

U.S. PATENT DOCUMENTS

| | | | |
|---|---|---|---|
| 1,864,728 | 6/1932 | Hawkins et al. | 131/84 R |
| 2,667,172 | 1/1954 | Broekhuysen et al. | 131/21 |
| 3,130,733 | 4/1964 | Martin | 131/280 |
| 3,159,746 | 12/1964 | Powell et al. | 131/280 |
| 3,320,528 | 5/1967 | Esenwein | 131/280 |
| 3,360,721 | 12/1967 | Pullman | 131/280 |
| 3,411,513 | 11/1968 | Knobel | 131/280 |
| 3,482,162 | 12/1969 | Wochnowski et al. | 131/280 |
| 3,560,801 | 2/1971 | McArthur | 131/280 |
| 3,595,067 | 7/1971 | Von Der Lohe | 131/280 |
| 3,648,035 | 3/1972 | Hart | 131/280 |
| 3,738,376 | 6/1973 | Auguste et al. | 131/280 |
| 3,742,795 | 7/1973 | Lipcon | 131/280 |
| 3,850,029 | 11/1974 | Swansen | 131/280 |
| 3,905,123 | 9/1975 | Fowler et al. | 131/280 |
| 3,999,134 | 12/1976 | Lorenzen | 131/21 B |
| 4,030,511 | 6/1977 | Wahle | 131/280 |
| 4,033,360 | 7/1977 | Nienowet al. | 131/280 |
| 4,196,740 | 4/1980 | Rudszinat | 131/21 B |

*Primary Examiner*—V. Millin

[57] ABSTRACT

A practice for controlling cigarette rod firmness in a cigarette maker wherein a detected cigarette rod firmness signal is corrected for firmness variations resulting from changes in rod moisture relative to a preselected or target moisture via a suitably processed detected moisture signal and the corrected firmness signal is compared with a preselected or target firmness to derive an error signal for tobacco content control.

28 Claims, 1 Drawing Figure

FIRMNESS CONTROL IN A CIGARETTE MAKER

BACKGROUND OF THE INVENTION

1. Field of the Invention

This invention pertains to cigarette manufacture and, in particular, to a method and apparatus for controlling cigarette firmness during such manufacture.

2. Description of the Prior Art

In the manufacture of cigarettes, various practices have been employed at the cigarette maker to provide continuous control over cigarette rod parameters. Thus, for example, systems have been proposed for monitoring rod tobacco density and using monitored density to control cigarette rod tobacco content. British Specification No. 1,376,747 discloses one such system in which microwave energy is utilized to detect rod tobacco density. In this system, since the microwave energy employed is affected by moisture as well as tobacco, two separate signals are generated, each signal being dependent upon the tobacco mass and the water mass in the cigarette rod. These signals are used to derive the individual tobacco and water mass values.

Another type of practice at the cigarette maker involves control of the maker to provide a preselected or target firmness for the issuing cigarette rod. In this practice, rod firmness is detected by a suitable firmness sensor which might comprise a plurality of mechanical contiguous feelers, or non-contiguous pneumatic or electrical devices. Such practice further contemplates comparing the detected firmness with the target firmness to develop an error signal for controlling the tobacco content provided by the maker to the rod. Thereby, rod firmness is made to approach target firmness in typical control system fashion. Systems of this general type are disclosed, for example, in U.S. Pat. Nos. 3,411,513; 3,595,067 and 3,850,029.

Attendant on the latter practice is variation of tobacco content for cigarette rod firmness variations due not only to tobacco character changes but also to moisture content changes. Effecting control in this manner is wasteful of tobacco and prohibits cigarette maker operation at maximum efficiency.

It is therefore a primary object of the present invention to provide a method and apparatus for controlling cigarette firmness in a manner which promotes cigarette maker efficiency.

It is a further object of the present invention to provide a method and apparatus which avoids excessive addition and/or subtractions of tobacco during cigarette maker operation.

SUMMARY OF THE INVENTION

In accordance with the principles of the present invention, the above and other objectives are accomplished in a practice wherein detected cigarette rod firmness is corrected for firmness variations resulting from changes in rod moisture relative to a preselected or target moisture via a suitably processed detected moisture signal. The corrected firmness signal is compared in standard fashion with a preselected target firmness value to derive an error signal for tobacco content control at the cigarette maker.

With the present practice, firmness deviations resulting from moisture changes referenced to target moisture are removed from detected firmness and do not contribute to the error signal. Tobacco content variation at the maker is thereby made independent of such moisture changes, whereby maker efficiency is enhanced.

The present practice contemplates the detection of at least two cigarette rod parameters, i.e., rod firmness and rod moisture, and the processing of such detected parameters to afford control of the cigarette maker promotive of maker efficiency. In further practice under the present invention, attendant specific moisture sensor apparatus, a third cigarette rod parameter, namely, density, is also detected and processed with the firmness and moisture parameters to provide the desired cigarette maker control.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

Figure 1:
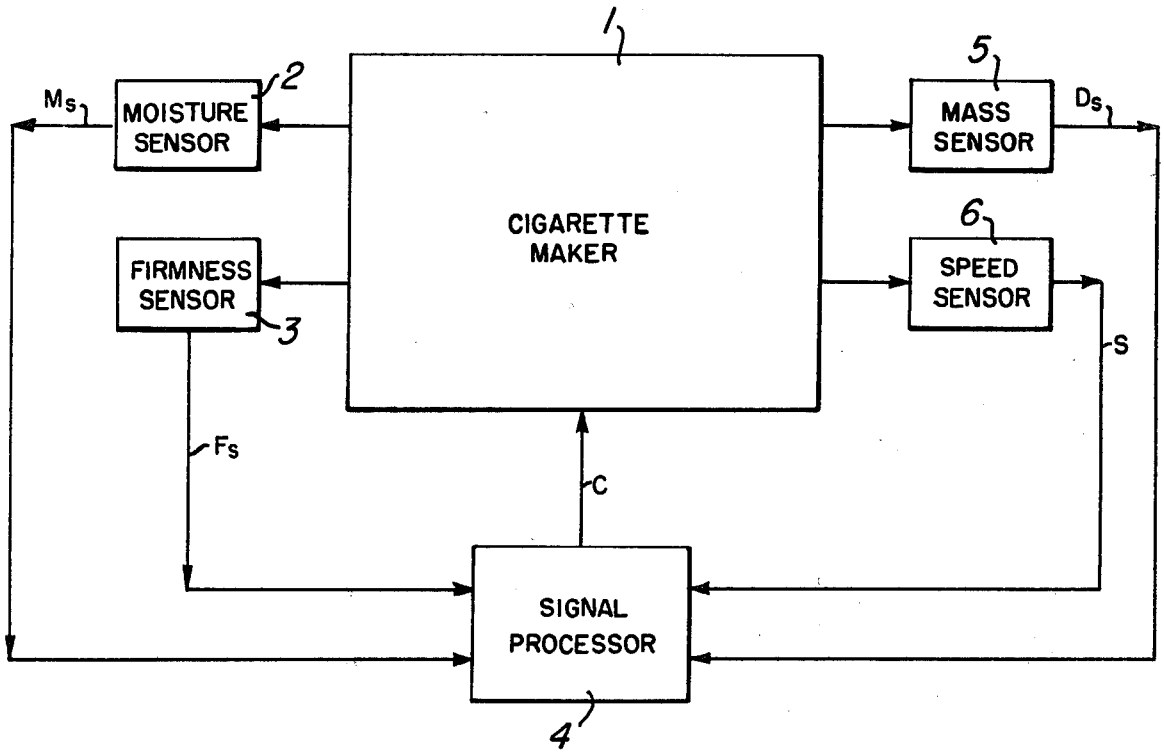
FIG. 1 shows a system for controlling cigarette rod firmness at a cigarette maker in accordance with the principles of the present invention.

FIG. 1 shows a system in accordance with the principles of the present invention for providing firmness control at a cigarette maker 1. The latter maker can be of conventional type such as that manufactured by Molins Ltd. of the United Kingdom under model number Mk. 8 or Mk. 9.

In typical operation, the maker 1 provides a continuous cigarette rod which is cut into lengths to provide individual cigarettes. During this operation, it has been proposed to control, amongst other parameters, the firmness of the rod so that it is maintained at a preselected or target firmness value. Resulting from this control are cigarettes having substantially the same feel, this being a cigarette characteristic desired by cigarette smokers.

In the present practice, firmness control is effected in a manner which affords greater economy and efficiency to maker operation. More particularly, in accordance with the present invention, a moisture sensor 2 and a firmness sensor 3 are utilized to provide output electrical signals $M_s$ and $F_s$ related to the moisture content and the firmness of the cigarette rod of the maker 1. These signals are together processed in a signal processor 4 which provides an output control signal C for controlling the tobacco content being provided by the maker to the cigarette rod. In conventional manner, the control signal C might be employed to adjust the height of the ecreteur blade used to cut the tobacco stream at a given depth during rod formation. Alternatively, the control signal C might be used to control the tobacco feed to the maker hopper to obtain the desired tobacco content control. Such practices are disclosed, for example, in the aforementioned U.S. Pat. No. 3,595,067.

The processing operations of the signal processor 4 involve the generating of a rod moisture content signal $M_c$ from the moisture sensor signal $M_s$ and the formation of a corrected rod firmness signal $F_{cor}$ from the firmness sensor signal $F_s$. The moisture content signal $M_c$ is utilized to determine the content of the firmness sensor signal $F_s$ attributable to cigarette rod moisture changes referenced to a target or desired rod moisture value $M_t$. The resultant rod firmness content signal $F_{sm}$ is combined with the firmness sensor signal $F_s$ to provide the corrected firmness signal $F_{cor}$. Comparison of the corrected firmness signal $F_{cor}$ with a preselected or target cigarette rod firmness value $F_t$ provides the control signal C.

It is known that for a particular tobacco blend, maker cigarette rod firmness is a linear function of rod moisture content. Rod firmness attributable to moisture can thus be expressed as follows:

$$F_m = K_0 + K_1 M_c \quad (1)$$

where $K_0$ is a constant determined by the tobacco blend and the rod weight per unit volume and $K_1$ is a negative constant determined by the tobacco blend only. Firmness content attributable to moisture referenced to target moisture is therefore given as $$F_{sm} = K_1(M_c - M_t) \quad (2)$$

It follows that corrected firmness is expressed as $$F_{cor} = F_s - F_{sm} \quad (3)$$

and the control signal C as $$C = (F_s - F_{sm}) - F_t \quad (4)$$

The signal processor 4 determines the control signal C based on the expressions 1–4 and, for example, might take the form of a general or special purpose digital computer programmed in accordance with the latter expressions and having stored therein the target values and appropriate constants. A typical microcomputer might be an Intel System 80/204 provided with an Intel System SBC 116 board. Interfacing such microcomputer with the analog signals $M_s$, $F_s$ and C might typically be a model MP 8418-PGA-AO Burr-Brown A/D-D/A converter.

As above-noted, the signal processor 4 first processes the moisture sensor signal $M_s$ to generate the moisture content signal $M_c$. This processing procedure depends to a large degree on the particular moisture sensor being used and is designed to provide a signal which is representative of the actual or true rod moisture content. Where the characteristics of the moisture sensor are such that the sensor signal $M_s$ is itself representative of true rod moisture content, then this processing is carried out by equating $M_c$ to $M_s$. On the other hand, where the sensor characteristics result in an $M_s$ signal varying from true rod moisture content, adjusting factors are provided to account for the influence of the sensor characteristics. In actual practice, these adjusting factors can be empirically determined for each particular moisture sensor.

As will be discussed hereinbelow, in further practice in accordance with the present invention, a further sensor 5 for sensing the mass or density of the cigarette rod is employed for enabling moisture sensor signal adjustment. In still further practice under the present invention, a speed or velocity sensor 6 may be provided for cigarette rod speed determination and included for sensor signal adjustment.

A first sensor which might be employed for the sensor 2 could be a resistance type moisture sensor. Such a sensor might be formed on the above-mentioned conventional maker by inserting probes through apertures spaced along the length of the so-called tongue of the maker whereat the rod is being formed, the probes being of sufficient length to enter into the rod tobacco. A current or voltage could then be supplied to the probe and the resultant voltage or current through the probe circuit measured to determine the tobacco rod resistance and, therefore, the rod moisture content. In particular, such probes could serve as inputs to the internal circuitry of a model No. TM-80 sensor manufactured by Testron to provide the moisture measurement.

Utilizing such a resistance moisture sensor provides a moisture sensor signal $M_s$ requiring adjustment for arriving at the actual rod moisture content $M_c$. In particular, it has been found that the sensor moisture signal $M_s$ requires adjustment related to rod firmness and rod speed. Thus, for this sensor, moisture content can be expressed as follows:

$$M_c = A_0 + A_1 M_s + A_2 F_s + A_3 S \quad (5)$$

where $A_0$–$A_3$ are constants which can be empirically determined for each particular tobacco blend and resistance sensor.

With the resistance type sensor, the signal processor 4 utilizes the sensor signal $M_s$, the firmness sensor signal $F_s$ and the speed sensor signal S to derive the moisture content signal $M_c$ based on the expression 5. Where the processor 4 is a digital computer, the computer is programmed in accordance with such expression to provide calculation of the moisture content $M_c$.

Another technique for monitoring rod moisture content utilizes microwave components and depends upon microwave power absorbed largely by the moisture in the cigarette rod as it moves through a suitable microwave cavity. With this type of moisture sensor, the moisture sensor signal $M_s$ is a function of reflected and transmitted microwave power values in the absence and presence of the cigarette rod, these values being suitably adjusted for temperature variations, of the cavity and/or the rod. Hence, $M_s$ is as follows:

$$M_s = \frac{(R_a + T_a) - (R_p + T_p) \cdot 100}{(R_a + T_a)}$$

where $R_a$ and $T_a$ are temperature adjusted values of the reflectance and transmittance of microwave power in the absence of the cigarette rod and $R_p$ and $T_p$ are temperature adjusted values of the reflectance and transmittance in the presence of the cigarette rod. In this case, the obtained sensor signal $M_s$ requires adjustment related to the mass of the cigarette rod. Hence, the moisture content is given as:

$$M_c = B_0 + B_1 M_s / D_s \quad (6)$$

Again, in this situation the constants $B_0$ and $B_1$ can be empirically determined for the particular tobacco blend and microwave sensor being used. Also, the processor 4, if a digital computer, would now be programmed in accordance with the expression 6 to determine the moisture content $M_c$.

The firmness sensor 3 utilized with the present invention can be of a strain gauge type and may, for example, be of a type as shown and described in U.S. Pat. No. 4,033,360. Such a firmness sensor may be used with either of the above-described moisture sensors. Additionally, the mass sensor 5 might be a beta gauge type manufactured by Molins Ltd, and supplied with their model number Mk 8 or Mk 9.

The speed sensor 6, on the other hand, might be a simple tachometer of conventional design yielding a value of voltage to represent revolutions per minute.

A particular example of the present practice was carried out for a standard cigarette blend and target values $M_t$ and $F_t$ equal to 12.5% and 2.5, respectively, using a resistance sensor to measure $M_s$ and a strain gauge to measure $F_s$. In this case, the constants $K_1$ and $A_0$ through $A_4$ were determined to have the following approximate values.

| | |
|---|---|
| $A_0$ | 15.0 |
| $A_1$ | 0.43 |
| $A_2$ | −1.0 |
| $A_3$ | 0.00050 |
| $K_1$ | −0.838 |

In all cases, it is understood that the abovedescribed arrangements are merely illustrative of the many possible specific embodiments which represent applications of the present invention. Numerous and varied other arrangements can readily be devised in accordance with the principles of the present invention without departing from the spirit and scope of the invention.

What is claimed is:

1. Apparatus for use with a cigarette rod, said apparatus including:
first sensor means for providing a firmness sensor signal corresponding to the firmness of said rod;
second sensor means for providing a moisture sensor signal related to the moisture in said rod;
signal processing means responsive to said firmness and moisture sensor signals comprising:
means for providing a corrected firmness signal deviating from said firmness signal by an amount related to said moisture in said rod; and
means for comparing said corrected firmness signal with a preselected firmness value to generate a comparison signal.

2. Apparatus in accordance with claim 1 wherein:
said corrected firmness signal deviates from said firmness signal by an amount related to the deviation of said moisture content in said rod from a preselected moisture content.

3. Apparatus in accordance with claim 2 wherein:
said corrected firmness signal deviates from said firmness signal by an amount linearly related to the deviation of said moisture content in said rod from said preselected moisture content.

4. Apparatus in accordance with claim 1 wherein:
said signal processing means comprises a digital computer.

5. Apparatus for use with a cigarette rod, said apparatus including:
first sensor means for providing a firmness sensor signal related to the firmness of said rod;
second sensor means for providing a moisture sensor signal related to the moisture in said rod;
signal processing means responsive to said firmness and moisture sensor signals comprising:
means for providing a corrected firmness signal deviating from said firmness signal by an amount related to said moisture in said rod; said signal providing means: generating a moisture content signal corresponding to the actual moisture in said rod; generating from said moisture content signal a firmness content signal corresponding to the content of said firmness sensor signal attributable to the moisture content in said rod; and generating said corrected firmness signal by combining said firmness content signal and said firmness sensor signal; and
means for comparing said corrected firmness signal with a preselected firmness value to generate a comparison signal.

6. Apparatus in accordance with claim 5 wherein:
said firmness content signal is related to the deviation of said moisture content signal from a preselected moisture content.

7. Apparatus in accordance with claim 6 wherein:
said firmness content signal is linearly related to said deviation of said moisture content signal from said preselected moisture content.

8. Apparatus in accordance with claim 5 wherein:
said second sensor means is a resistance moisture sensor; and
said means for providing a corrected firmness signal generates said moisture content signal from said moisture sensor signal and said firmness sensor signal.

9. Apparatus in accordance with claim 8 wherein:
said apparatus further comprises a third sensor means for providing a speed sensor signal related to the speed of said rod; and
said means for providing a corrected firmness signal generates said moisture content signal from said speed sensor signal.

10. Apparatus in accordance with claim 5 further comprising:
a third sensor means for providing a mass sensor signal corresponding to the mass of said rod.

11. Apparatus in accordance with claim 10 wherein:
said second sensor means is a microwave moisture sensor; and
said means for providing a corrected firmness signal generates said moisture content signal from said moisture sensor signal and said mass sensor signal.

12. Apparatus in accordance with claim 8 or claim 10 wherein:
said first sensor means comprises a strain gauge.

13. Apparatus in accordance with claim 5 wherein:
said moisture sensor signal varies from the actual moisture content of said rod;
said apparatus further includes means for generating an adjustment signal corresponding to the variation of said moisture sensor signal from said actual moisture content; and
said means for providing a corrected firmness signal generates said moisture content signal from said moisture sensor signal and said adjustment signal.

14. Apparatus in accordance with claim 1 or 5 further comprising:
means responsive to said comparison signal for varying the tobacco content of said rod.

15. Apparatus in accordance with claim 1,5,6,7,8,9,10,11 or 13 further comprising:
a cigarette maker for providing said rod; and
means responsive to said comparison signal for controlling the operation of said maker to vary the tobacco content of said rod.

16. A method for use with a cigarette rod, said method including:
sensing the firmness of said rod to provide a firmness sensor signal;

sensing the moisture in said rod to provide a moisture sensor signal;

processing said firmness and moisture sensor signals including:

providing a corrected firmness signal deviating from said firmness signal by an amount related to said moisture in said rod; and comparing said corrected firmness signal with a preselected firmness value to generate a comparison signal.

17. A method in accordance with claim 16 wherein:

said corrected firmness signal deviates from said firmness signal by an amount related to the deviation of said moisture content in said rod from a preselected moisture content.

18. A method in accordance with claim 17 wherein:

said corrected firmness signal deviates from said firmness signal by an amount linearly related to the deviation of said moisture content in said rod from said preselected moisture content.

19. A method in accordance with claim 16 wherein:

said processing step is carried out by a digital computer.

20. A method for use with a cigarette rod, said method including:

sensing the firmness of said rod to provide a firmness sensor signal;

sensing the moisture in said rod to provide a moisture sensor signal;

processing said firmness and moisture sensor signals including:

providing a corrected firmness signal deviating from said firmness signal by an amount related to said moisture in said rod said providing step including: generating a moisture content signal corresponding to the actual moisture in said rod; generating from said moisture content signal a firmness content signal corresponding to the content of said firmness sensor signal attributable to the moisture content in said rod; and generating said corrected firmness signal by combining said firmness content signal and said firmness sensor signal; and comparing said corrected firmness signal with a preselected firmness value to generate a comparison signal.

21. A method in accordance with claim 20 wherein:

said firmness content signal is related to the deviation of said moisture content signal from a preselected moisture content.

22. A method in accordance with claim 21 wherein:

said firmness content signal is linearly related to said deviation of said moisture content signal from said preselected moisture content.

23. A method in accordance with claim 20 wherein:

the step of sensing the firmness of said rod is carried out with a strain gauge sensor; and the step of generating said moisture content signal is carried out with said moisture sensor signal and said firmness sensor signal.

24. A method in accordance with claim 23 further comprising:

sensing the speed of said rod to provide a speed sensor signal; and said step of generating said moisture content signal is carried out with said speed sensor signal.

25. A method in accordance with claim 20 further comprising:

sensing the mass of said output cigarette rod to provide a mass sensor signal.

26. A method in accordance with claim 25 wherein:

said step of sensing the moisture content of said rod is carried out with a microwave moisture sensor; and the step of generating said moisture content signal is carried out with said moisture sensor signal and said mass sensor signal.

27. A method in accordance with claim 1 or 20 further comprising:

varying the tobacco content of said rod in response to said comparison signal.

28. A method in accordance with claim 16,19,20,21,23 or 24 further comprising:

providing a cigarette maker for producing said rod; and controlling the operation of said cigarette maker to vary the tobacco content of said rod in response to said comparison signal.

* * * * *